US006132815A

United States Patent [19]

Takahashi et al.

[11] Patent Number: 6,132,815

[45] Date of Patent: Oct. 17, 2000

[54] FLUORORESIN-COATING PROCESS

[75] Inventors: Masaaki Takahashi, Asaka; Kazuo Kishino, Kawasaki; Hideo Kawamoto, Tokyo, all of Japan

[73] Assignee: Canon Kabushiki Kaisha, Tokyo, Japan

[21] Appl. No.: 09/065,441

[22] Filed: Apr. 24, 1998

[30] Foreign Application Priority Data

Apr. 25, 1997 [JP] Japan ..... 9-109250

[51] Int. Cl.[7] ..... B05P 3/06

[52] U.S. Cl. ..... 427/553; 427/557; 427/595; 427/144; 427/189; 427/198; 427/238; 427/271; 427/276; 427/277; 427/359; 264/319; 264/327; 264/492

[58] Field of Search ..... 427/553, 557, 427/595, 144, 145, 189, 198, 271, 276, 277, 359, 238; 264/492, 319, 327; 118/DIG. 10, DIG. 11, DIG. 13

[56] References Cited

U.S. PATENT DOCUMENTS

| | | | |
|---|---|---|---|
| 2,724,672 | 11/1955 | Rubin | 154/82 |
| 4,368,217 | 1/1983 | Tournut | 427/181 |
| 5,327,202 | 7/1994 | Nami et al. | 355/282 |

*Primary Examiner*—Timothy Meeks
*Attorney, Agent, or Firm*—Fitzpatrick, Cella, Harper & Scinto

[57] ABSTRACT

Disclosed herein is a fluororesin-coating process, which comprises the steps of inserting a base having powder of the fluororesin on its surface in the interior of a cylindrical face transfer member, and heating both base and face transfer member by means of an infrared heater from the outside of the face transfer member, thereby heating them in a state that the fluororesin powder layer is pressed by the face transfer member making good use of a difference in coefficient of thermal expansion between the base and the face transfer member to form a fluororesin layer.

8 Claims, 8 Drawing Sheets

FLUORORESIN-COATING PROCESS

BACKGROUND OF THE INVENTION

1. Field of the Invention

The present invention relates to a process for coating a cylindrical or columnar base with a fluororesin, a toner-fixing member produced by this process, and an electrophotographic apparatus equipped with the toner-fixing member, such as a copying machine or LBP.

2. Related Background Art

A fixing roller, fixing film, pressure roller and the like used as fixing members in electrophotographic image-forming apparatus are required to have good toner-parting or releasing property from the viewpoint of their use, and a fluororesin is often used for their surface layers.

When a full-color toner image is formed, a fixing roller or fixing film for fixing toner layers of 4 layers at the maximum must have such flexibility as can follow irregularities of toners and a transfer medium in order that a fluororesin layer, which is a toner-parting surface layer, completely transfers heat to the toners to provide good fixing ability of the toners to the transfer medium. Therefore, a fixing member having a construction such that a flexible elastic layer is provided under the fluororesin layer, or the toner-parting layer is used.

A fixing member obtained by forming an elastic layer on a cylindrical or columnar metal mandrel and forming a film of a fluororesin as a toner-parting layer around the peripheral surface of the elastic layer has often been used as a fixing member for an electrophotographic image-forming apparatus. Recently, a fixing member obtained by forming an elastic layer on a core made of a heat-resisting resin and forming a film of a fluororesin as a toner-parting layer around the peripheral surface of the elastic layer has also been used.

As a process for coating a peripheral wall of a cylindrical or columnar base with a fluororesin, a process in which powder or a dispersion of the fluororesin is applied onto the base and then heated and calcined has been used. When the fluororesin is heated and calcined, it heats the fluororesin up to at least the melting point thereof so as to calcine it into a film.

However, the fluororesin-coating process like the conventional process involves the following problems.

First of all, in the case where the base is an elastic body, a fluororesin is applied onto the elastic body and heated and calcined, the smoothness of a fluororesin layer formed into a film is lowered because of the extremely high melt viscosity of the fluororesin even when the fluororesin is heated and calcined at a considerably higher temperature than the melting point of the fluororesin. When such fluororesin-calcining conditions as described above are practiced, the elastic body is damaged to an extremely great extent because there is no elastic body which can withstand such a high temperature. As a result, the compression set of the elastic layer deteriorates, resulting in a failure to attain the good paper-feeding property required of fixing members. When the calcining temperature of the fluororesin is lowered in order to reduce such damage, the fluororesin is not quite melted which causes problems that the surface of the fluororesin layer cracks, and the desired surface profile cannot be achieved.

In order to solve the above problems, the present inventors have proposed a process of heating, calcining and forming a fluororesin into a layer while pressing the fluororesin layer between the elastic body and a face transfer member arranged outside the fluororesin layer to transfer the surface pattern of the face transfer member to the surface of the fluororesin. As a result, it became possible to form the fluororesin into a film at a temperature lower than usual while controlling the surface pattern of the fluororesin, and so it followed that the damage of the underlying elastic body (rubber) could be reduced to a comparatively small extent. However, even this process was unable to completely prevent damage to elastic body (rubber).

SUMMARY OF THE INVENTION

Accordingly, it is an object of the present invention to provide a process for coating a cylinder or column with a fluororesin on the peripheral wall, which can solve the above-described various problems.

Another object of the present invention is to provide a fluororesin-coating process by which a fluororesin layer free of any cracks can be coated on a base.

A further object of the present invention is to provide a fluororesin-coating process by which a fluororesin layer having a desired surface roughness can be coated on a base.

A still further object of the present invention is to provide a toner-fixing member produced by using the above fluororesin-coating process, and an electrophotographic apparatus equipped with such a toner-fixing device.

The above objects can be achieved by the present invention described below.

According to the present invention, there is thus provided a fluororesin-coating process which comprises the steps of inserting a base having powder of the fluororesin on its surface in the interior of a cylindrical face transfer member; and heating both base and face transfer member by means of an infrared heater from the outside of the face transfer member, thereby heating them in a state that the fluororesin powder layer is pressed by making use of a difference in the coefficient of thermal expansion between the base and the face transfer member to form a fluororesin layer.

According to the present invention, there is also provided a cylindrical or columnar toner-fixing member to be used on the side of coming into direct contact with a toner, which comprises a fluororesin layer formed in accordance with the fluororesin-coating process described above.

According to the present invention, there is further provided a cylindrical or columnar toner-fixing member to be used on the side of driving a transfer medium, which comprises a fluororesin layer formed in accordance with the coating process described above.

According to the present invention, there is still further provided an electrophotographic apparatus comprising a photosensitive member, a means for forming a latent image, a means for developing the formed latent image with a toner, a means for transferring the developed toner image to a transfer medium, and a means for fixing the toner image on the transfer medium, wherein the fixing means is a member produced through the steps of inserting a base having powder of a fluororesin on its surface in the interior of a cylindrical face transfer member; and heating both base and face transfer member by means of an infrared heater from the outside of the face transfer member, thereby heating them in a state that the fluororesin powder layer is pressed by making good use of the difference in the coefficient of thermal expansion between the base and the face transfer member to form a fluororesin layer.

According to the present invention, powder of a fluororesin (FEP, PFA, PTFE or the like) or a water-based coating comprising the fluororesin is coated on a base such as a cylinder or column to form a fluororesin powder layer, and both the coated base and a cylindrical face transfer member arranged outside the base are heated while pressing the fluororesin powder layer between the base and the face transfer member making good use of a difference in coefficient of thermal expansion between the base and the face transfer member. As a heating method, an infrared heater is used to conduct the heating under pressure from the outside of the face transfer member, whereby the fluororesin powder layer, or the surface layer of the base, can be efficiently heated, and the surface pattern of the face transfer member can be transferred to the surface of the fluororesin layer. In such a manner, it becomes possible to impart the desired pattern or roughness to the surface of the fluororesin layer.

In the present invention, a fluororesin layer free of any cracks is formed by heating the fluororesin powder layer under pressure, and so the heating conditions are relaxed. In addition, since the heating is conducted from the side of the face transfer member, the deterioration of another polymer layer, such as a rubber layer by heat can be prevented if the polymer layer, is provided under the fluororesin layer.

BRIEF DESCRIPTION OF THE DRAWINGS

FIG. 1B is a cross-sectional view of a base coated with the fluororesin.

FIG. 2B is a cross-sectional view of a base coated with the fluororesin.

FIG. 3B is a cross-sectional view of a base coated with the fluororesin.

FIG. 4B is a cross-sectional view of a base coated with the fluororesin.

FIG. 5B is a cross-sectional view of a base coated with the fluororesin.

FIG. 6B is a cross-sectional view of a base coated with the fluororesin.

FIG. 7B is a cross-sectional view of a base coated with the fluororesin.

DESCRIPTION OF THE PREFERRED EMBODIMENTS

Figure 1A:
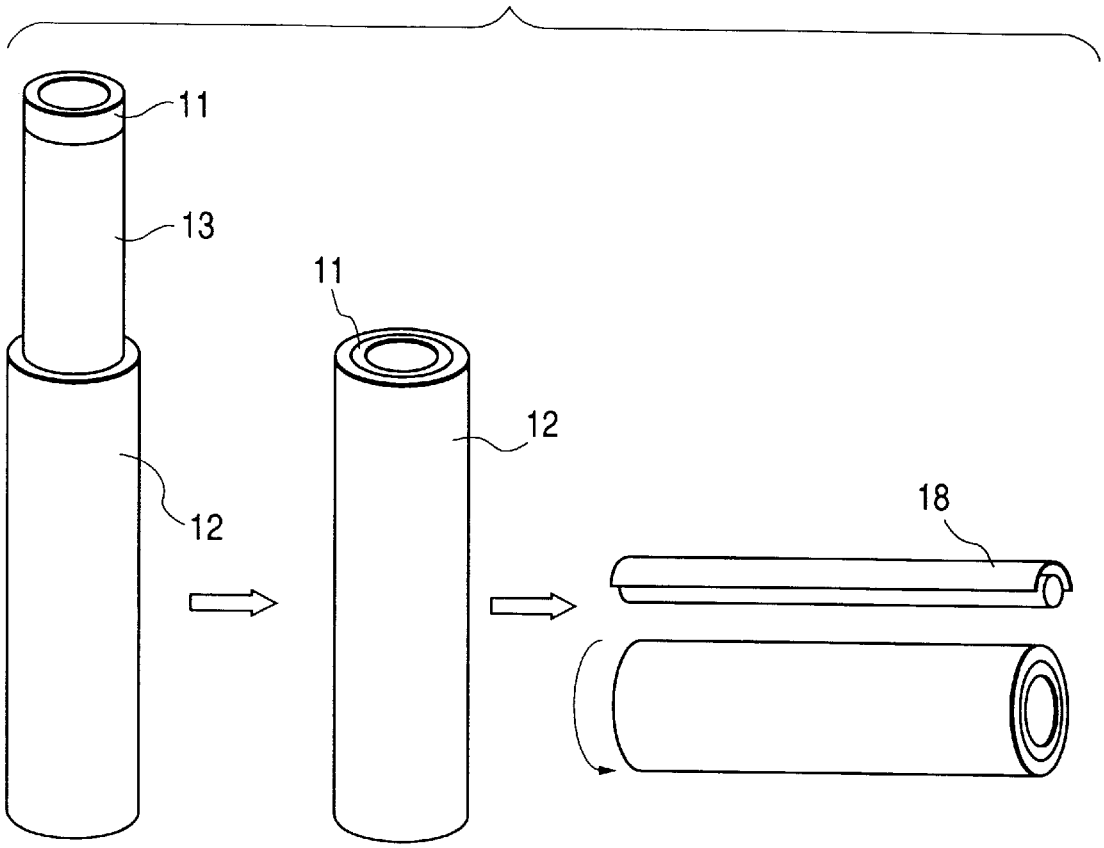
FIGS. 1A and 1B are explanatory drawings of Example 1, wherein FIG. 1A schematically illustrates a fluororesin-coating process.

The coating of the surface of a base with fluororesin powder may be conducted by electrostatic coating. However, it is preferable, from the viewpoint of ease, to use a water-based coating comprising the fluororesin powder.

It is also preferable from the viewpoint of handling to preliminarily heat and calcine the fluororesin powder on the surface of the base so as to fix the fluororesin to the surface of the base.

It is further preferable from the viewpoint of efficient heating that the face transfer member should transmit at least 50% of infrared radiation. Still further, it is preferable from the viewpoint of efficient heating of the fluororesin layer by infrared heating that the degree of infrared absorption of the individual components should be in the following relation:

$$\text{face transfer member} \leqq \text{fluororesin layer} < \text{base surface}.$$

No particular limitation is imposed on the cylindrical or columnar base in the present invention. However, a mandrel made of a metal such as iron or aluminum, or a base of a multi-layer structure obtained by forming a layer of heat-resisting rubber such as silicone rubber or fluororubber on the above mandrel may be used. These bases are suitable for use as bases for fixing rollers. As a base for a fixing film may be used a film formed of a heat-resisting resin such as polyimide, or a metal such as nickel or iron, or a base of a multi-layer structure obtained by forming a layer of heat-resisting rubber such as silicone rubber or fluororubber on the above film.

The actual construction of the base (base layer) is described in detail in Examples, which will be described subsequently, and the accompanying drawings. However, examples thereof include (1) mandrel—layer of fluororesin primer;

(2) mandrel—layer of silicone rubber primer—silicone rubber—layer of mixed fluororubber and fluororesin; and (3) polyimide film—layer of silicone rubber primer—silicone rubber—layer of mixed fluororubber and fluororesin.

Examples of the fluororesin used in the present invention include commercially available perfluoroethylene propylene resins (FEP), perfluoroalkoxy resins (PFA) and polytetrafluoroethylene resins (PTFE).

No particular limitation is imposed on a material for the cylindrical face transfer member so far as it can withstand a temperature required to calcine and form the fluororesin powder into a film. It is however preferable to use a metallic material such as iron, SUS or aluminum, or a heat-resisting resin such as polyimide or polyphenylene sulfide. When a thin-layer tube made of polyimide, Ni-electroformed film or glass is used as the face transfer member, it is possible to use it repeatedly because it is easy to handle and has excellent heat resistance and high-temperature strength, so that the durability of the face transfer member is enhanced.

The face transfer member is required to be in a cylindrical form and have an internal diameter somewhat greater than the external diameter of the cylindrical or columnar base provided with the fluororesin powder layer and a length at least equal to that of the base. A clearance formed upon fitting of the base and the face transfer member varies depending on a difference in coefficient of thermal expansion therebetween upon heating. However, it is preferably as narrow as possible and generally within a range of from 5 to 1,000 $\mu$m.

With respect to finishing of the inner surface of the face transfer member, in the case of (1) a member (metal member) manufactured by removal working, the inner surface thereof is first worked by drilling, lathe working or the like and then finished by honing to the desired surface roughness. When the inner surface is intended to be roughened, blast finishing is conducted after honing.

In the case of (2) a member (metal-electroformed film or resin film) manufactured by addition processing, a master rod for the face transfer member is produced, a metal or resin is applied onto the surface of the master rod, and the film formed is removed from the master and used. It is only necessary to finish the surface of the master by cutting, abrasion, polishing and/or the like to the desired surface roughness. It is also possible to roughen or pattern the surface of the master by blasting, etching or the like so as to transfer it to the inner surface of the face transfer member.

No particular limitation is imposed on the infrared heater for heating the united body obtained by inserting the base coated with the fluororesin powder in the interior of the face transfer member. For example, a line heater of the parallel light type having a length equal to that of the face transfer member is used. The axes of both heater and face transfer member are kept parallel to each other at a proper interval, and the heating is conducted while rotating the face transfer member on its axis. The output of the heater and an interval between the heater and the face transfer member may be suitably determined in such a manner that the united body is evenly heated in heating time ranging from several minutes to ten-odd minutes. The temperature of the fluororesin layer upon the heating is a melting temperature of a fluororesin used and varies according to the fluororesin used. However, the temperature is generally within a range of from about 280° C. to 320° C.

It is also permissible to conduct the above process after preliminarily heating and calcining the fluororesin powder layer into a film in advance. The preliminary heating and calcination of the fluororesin may be conducted until the fluororesin is formed into a complete film. However, there is no particular necessity for doing so. It is only necessary to raise the temperature of the fluororesin to a melting temperature thereof for a moment. At this time, cracks and irregularities may exist in the surface of the fluororesin layer. No particular limitation is imposed on the temperature of the fluororesin layer in the step of heating both the base coated with the fluororesin layer and the face transfer member after the preliminary heating and calcination so far as it is 200° C. or higher. However, it is not necessary to raise the temperature up to the melting temperature of the fluororesin. The temperature is preferably within a range of from 240° C. to 290° C. The use of this method permits imparting a desired surface pattern to the surface of the fluororesin layer using less heat than the case where no preliminary heating and calcination are conducted. When a material having poor heat resistance, such as a resin or rubber, is used as a base material, the deterioration of the base material by heat occurs upon the heating and calcination of the fluororesin. However, the use of this method can prevent the heat deterioration of the base material by heat by virtue of quick heating by infrared radiation. Since high temperature is not necessary upon the pressing of the fluororesin layer, operating efficiency is also improved, and moreover the weight of equipment such as a pressing device can be reduced. As described above, no particular limitation is imposed on the material of the face transfer member.

When the coefficient of thermal expansion of the base coated with the fluororesin is higher than that of the face transfer member, the fluororesin layer is pressed between the base and the face transfer member since the thermal expansion of the base is greater than that of the face transfer member when the base coated with the fluororesin is inserted in the interior of the face transfer member, and both base and face transfer member are heated by means of the infrared heater from the outside of the face transfer member, whereby the internal surface pattern of the face transfer member is transferred to the surface of the fluororesin layer.

When the coefficient of thermal expansion of the base coated with the fluororesin is lower than that of the face transfer member, on the other hand, the outer surface of the face transfer member is fixed, the base coated with the fluororesin is inserted in the interior of the face transfer member, and both base and face transfer member are heated by means of the infrared heater from the outside of the face transfer member, whereby the fluororesin layer is pressed between the face transfer member the outer surface of which has been fixed, and the base, and the internal surface pattern of the face transfer member is transferred to the surface of the fluororesin layer.

In any process, the base may be composed of multi-layers, and the surface layer of the base may be formed of heat-resisting rubber.

When the heating is conducted from the outside of the face transfer member to press the fluororesin between the base and the face transfer member into a film, the formation of the fluororesin film can be easily conducted even when the temperature applied to the fluororesin upon the calcination of the fluororesin into the film is preset lower, the fluororesin layer situated at the surface of the base can be directly heated, and quick heating is feasible. Therefore, the deterioration of the base can be prevented. At this time, the internal surface form of the face transfer member can be transferred to the surface of the fluororesin, whereby a desired pattern can be formed on the surface of the fluororesin. When the face transfer member is composed of a material having a transmittance of at least 50% to infrared radiation, energy of infrared radiation is transmitted to the fluororesin without the energy being absorbed in the face transfer member itself to a very great extent, and the thermal expansion of the face transfer member is lowered, whereby the internal surface form of the face transfer member can be transferred to the surface of the fluororesin with lower energy to form a desired pattern on the surface of the fluororesin. Namely, the deterioration of the base layer by heat can be prevented to a greater extent. When the degree of infrared absorption of the individual components is in the following relation:

face transfer member ≦ fluororesin layer < base surface (fusion-bonding interface), the fusion-bonding interface can be directly heated, and the interal surface form of the face transfer member can be efficiently transferred to the surface of the fluororesin to form a desired pattern on the surface of the fluororesin.

When the inner surface of the cylindrical base is cooled before the heating and/or during the heating, the deterioration of the base layer by heat can be further prevented.

Fixing members used in electrophotographic image-forming apparatus are required to have good toner-parting property from the viewpoint of their functions. Among the fixing members, particularly, a fixing roller and a fixing film which come into contact with a toner are required to have high smoothness at their fluororesin surface layers for the purpose of preventing gloss irregularity in the printed image. The gloss irregularity in the printed image is caused by the transfer of the surface pattern of the fluororesin surface layer of the fixing roller or fixing film to the surface of a toner image and is markedly developed when a solid printed image, particularly, a color image of photographic printing is printed. According to the investigation by the present inventors, it has been found that the occurrence of gloss irregularity in printed image depends on the surface roughness of the fixing roller or fixing film. The gloss irregularity can be prevented by controlling the surface roughness of the fluororesin surface layer of the fixing roller or fixing film to 5 μm or smaller in terms of a ten point mean roughness (Rz). However, as described above, it has been extremely difficult to form a fluororesin surface layer having a desired surface roughness. Therefore, in order to prevent gloss irregularity in an image, control of the surface roughness by abrading the fluororesin surface layer of the fixing roller or fixing film has been done.

The use of the process of the present invention has made it possible to form a desired pattern on the fluororesin surface layer of the fixing roller or fixing film by coating the base of the fixing roller or fixing film with fluororesin powder and pressing the base of the fixing roller or fixing film with the face transfer member while heating the fluororesin powder by means of the infrared heater from the outside of the face transfer member. Namely, when a pattern having a roughness of 5 μm or smaller is formed on the inner surface of the face transfer member in advance, the internal surface form of the face transfer member is transferred to the surface of the fluororesin surface layer of the fixing roller or fixing film, whereby the fluororesin can be formed into a film having a desired roughness of 5 μm or smaller. As a result, gloss irregularity in the image can be prevented. When the roughness (Rz) of a pressure roller is 20 μm or smaller, any image roughness is not observed.

Among the fixing members, a fixing member particularly required to have good transfer-medium-feeding property must have a somewhat great roughness at its fluororesin surface layer to perform good transfer-medium feeding ability. According to the investigation by the present inventors, it has been found that the surface roughness of the fluororesin layer sufficient to feed a transfer medium falls within a range of from 2 to 20 μm in terms of a ten point mean roughness (Rz). The best surface roughness is determined within the above range according to the feeding property and other performance (image performance and the like) required.

The use of the process of the present invention has made it possible to form a desired pattern on the fluororesin surface layer of the fixing member by coating a base of the fixing member with fluororesin and pressing the fluororesin on the base with the face transfer member while heating the fluororesin by means of the infrared heater from the outside of the face transfer member. Namely, when a pattern having a roughness of from 2 to 20 μm is formed on the inner surface of the face transfer member in advance, the internal surface form of the face transfer member is transferred to the surface of the fluororesin surface layer of the fixing member, whereby the fluororesin can be formed into a film having a desired roughness ranging from 2 to 20 μm. As a result, the required transfer-medium-feeding property can be imparted to the fixing member.

Figure 10:
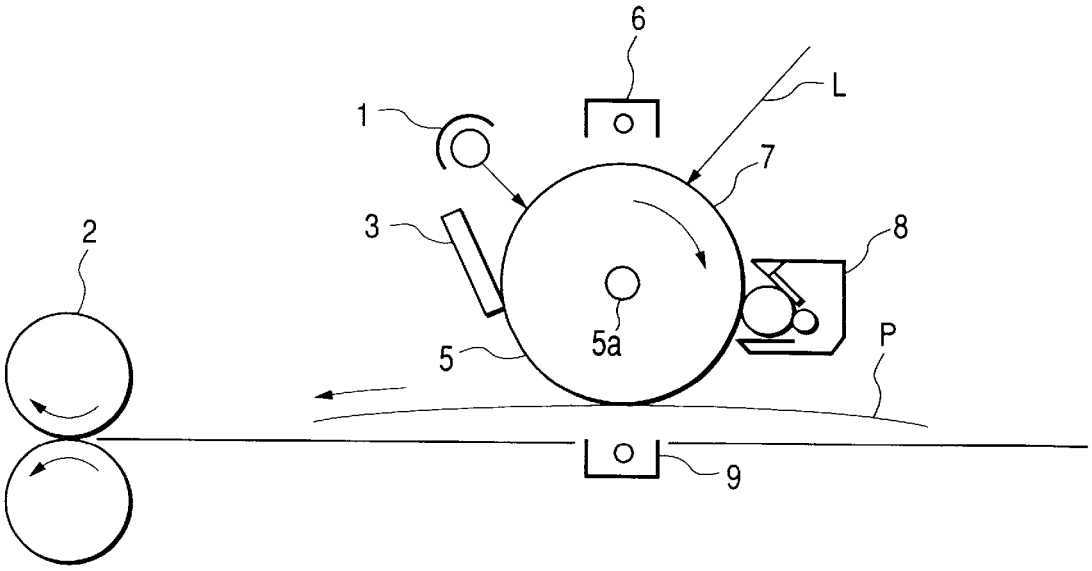
FIG. 10 schematically illustrates an electrophotographic apparatus.

As electrophotographic apparatus to which the toner-fixing member according to the present invention is applied, may be mentioned electrophotographic apparatus comprising a photosensitive member, a means for forming a latent image, a means for developing the formed latent image with a toner, a means for transferring the developed toner image to a transfer medium, and a means for fixing the toner image on the transfer medium. An example of such apparatus is illustrated in FIG. 10. In FIG. 10, reference numeral 5 indicates a photosensitive member which is rotatably driven at a predetermined peripheral velocity on its axis 5*a* in the direction of the arrow. The photosensitive member 5 is uniformly charged either positively or negatively at its peripheral surface by a charging means 6 in the course of its rotation and then subjected to light-image exposure L (slit exposure, laser beam scanning exposure or the like) by an image exposure means (not illustrated) in an exposure section 7, thereby successively forming an electrostatic latent image corresponding to the image exposure on the peripheral surface of the photosensitive member.

The electrostatic latent image is then developed with a toner by a developing means 8. The developed toner image is successively transferred by a transfer means 9 to the surface of a transfer medium P fed between the photosensitive member 5 and the transfer means 9 from a paper feeding section (not illustrated) in synchronism with the rotation of the photosensitive member 5. The transfer medium P to which the toner image has been transferred is separated from the surface of the photosensitive member 5 and guided into an image-fixing means 2, whereby the image is fixed. The transfer medium P on which the toner image has been fixed is then discharged as a copy from the apparatus. After the transfer of the image, the toner remaining on the surface of the photosensitive member 5 is removed by a cleaning means 3, thereby cleaning the surface of the photosensitive member 5. The thus-cleaned photosensitive member is subjected to a charge eliminating treatment by a preexposure means 1 and then used repeatedly for formation of images. As the means 6 for uniformly charging the photosensitive member 5, a corona charging device or a directly charging device using an electroconductive roller is used. As the transfer means 9, is also used a corona transfer device or a direct charging device using an electroconductive roller.

The present invention will hereinafter be described more specifically by the following Examples.

EXAMPLE 1

Figure 1B:
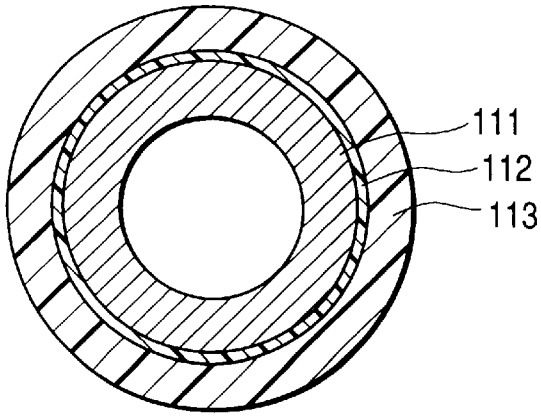

The first example of the present invention is described with reference to FIGS. 1A and 1B.

Reference numeral 11 designates a cylindrical base having a fluororesin coating 13 as its outermost layer. Its cross section is illustrated in FIG. 1B. Reference numeral 111 indicates a mandrel of the cylindrical base, which is formed of aluminum and has an external diameter of 40 mm. A fluororesin primer layer 112 is formed on the mandrel 111 for bonding a fluororesin surface layer to the mandrel. A fluororesin coating layer 113 is formed on the primer layer 112. The primer layer 112 was formed by applying a water-based coating comprising a fluororesin primer by spraying, and drying the coating at 150° C. for 30 minutes. At this time, the thickness thereof was 8 μm. After completion of the application of the primer layer as described above, a dispersion of a fluororesin (PFA) was further applied by spraying, and dried at 150° C. for 30 minutes. The thickness of the fluororesin layer was 25 μm.

Reference numeral 12 indicates a face transfer member, which is in the form of a cylinder having an internal diameter of 40.1 mm and a wall thickness of 0.05 mm. A surface pattern intended to transfer to the fluororesin film coated on the base is formed on the inner surface of the face transfer member 12. In this example, the inner surface of the face transfer member 12 was worked to a surface roughness of 5 μm before use. In this example, a Ni-electroformed film having a coefficient of thermal expansion lower than the base 11 was used as a material for the face transfer member 12.

The base 11 coated with the fluororesin was inserted in the interior of the face transfer member 12, and they were fixed and united together by a fixing member (not illustrated) in such a manner that the center lines thereof coincide. At this time, there was a clearance of about 20 μm between the base 11 coated with the fluororesin and the face transfer member 12. The base 11 coated with the fluororesin and the face transfer member 12, which were united as described above, were heated by an infrared heater 18 from the outside of the face transfer member 12. In this example, an infrared line heater (parallel light type) having an output of 3 kW and a length (300 mm) almost equal to the base was arranged about 50 mm apart from the surface of the face transfer member. In this state, heating was conducted for about 10 minutes at 3 kW. At this time, the thermal expansion of aluminum making up the base is greater than Ni constituting the face transfer member, and consequently the aluminum mandrel expands to a greater extent than the face transfer member composed of Ni, thereby creating a state that the clearance of about 20 μm defined between the face transfer member and the base is filled, and the fluororesin layer is further pressed. In addition, the fluororesin (PFA) on the surface of the base is softened by the infrared heating to form a film. After completion of the above process, the base and the face transfer member are cooled to pull the base out of the face transfer member.

The surface roughness of the calcined film of the fluororesin thus obtained was 5 μm in terms of a ten point mean roughness (Rz), the surface pattern of the face transfer member was transferred to the surface of the fluororesin layer, and the fluororesin was formed into a film. The surface of the fluororesin layer formed into the film was observed through an electron microscope. As a result, no defects such as cracks was observed on the surface. The processing was able to be conducted in a far shorter period of time than heating (about 20 minutes) by an oven.

EXAMPLE 2

Figure 2A:
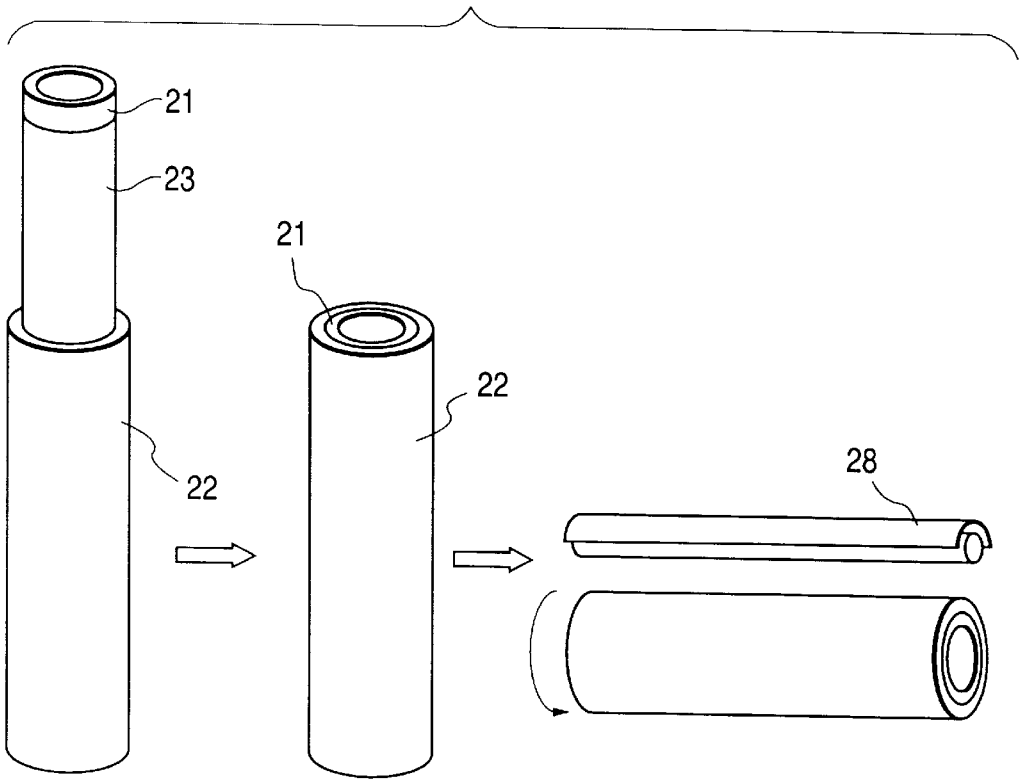
FIGS. 2A and 2B are explanatory drawings of Example 2, wherein FIG. 2A schematically illustrates a fluororesin-coating process.
Figure 2B:
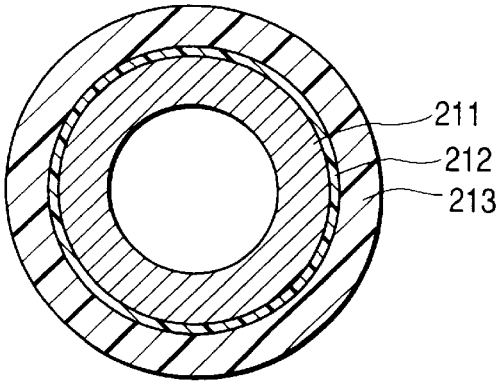

The second example of the present invention is described with reference to FIGS. 2A and 2B.

Reference numeral 21 designates a cylindrical base having a fluororesin coating 23 as its outermost layer. Its cross section is illustrated in FIG. 2B. Reference numeral 211 indicates a mandrel of the cylindrical base, which is formed of aluminum and has an external diameter of 40 mm. A fluororesin primer layer 212 is formed on the mandrel 211 for bonding a fluororesin surface layer to the mandrel. A fluororesin coating layer 213 is formed on the primer layer 212. The primer layer 212 was formed by applying a water-based coating comprising a fluororesin primer by spraying, and then drying the coating at 150° C. for 30 minutes. At this time, the thickness thereof was 8 μm. The fluororesin coating layer was formed by applying a dispersion of a fluororesin (PFA) by spraying after completion of the application of the primer layer as described above, and drying the dispersion coated at 150° C. for 30 minutes followed by preliminarily heating and calcining at 350° C. for 20 minutes. The thickness of the fluororesin layer was 25 μm. At this time, the fluororesin was not completely formed into a film, and defects such as cracks and irregularities were observed on its surface. The surface roughness thereof was 15 μm in terms of a ten point mean roughness (Rz). Reference numeral 22 indicates a face transfer member, which is in the form of a cylinder having an internal diameter of 40.1 mm and a wall thickness of 0.05 mm. A surface pattern intended to transfer to the fluororesin film coated on the base is formed on the inner surface of the face transfer member 22. In this example, the inner surface of the face transfer member 22 was worked to a surface roughness of 5 μm before use. A Ni-electroformed film having a coefficient of thermal expansion lower than the base 21 was used as a material for the face transfer member 22. The base 21 coated with the fluororesin layer preliminary heated and calcined was inserted in the interior of the face transfer member 22, and they were fixed and united together by a fixing member (not shown) in such a manner that the center lines thereof coincide. At this time, there was a clearance of about 20 μm between the base 21 coated with the fluororesin and the face transfer member 22. The base 21 coated with the fluororesin preliminarily heated and calcined and the face transfer member 22, which were united as described above, were heated by an infrared heater 28 from the outside of the face transfer member 22. In this example, an infrared line heater (parallel light type) having an output of 3 kW and a length (300 mm) almost equal to the base was arranged about 50 mm apart from the surface of the face transfer member. In this state, heating was conducted for about 8 minutes at 3 kW. At this time, the thermal expansion of aluminum making up the base is greater than Ni constituting the face transfer member, and consequently the aluminum mandrel expands to a greater extent than the face transfer member composed of Ni, thereby creating a state that the clearance of about 20 μm defined between the face transfer member and the base is filled, and the fluororesin layer is further pressed. In addition, the fluororesin (PFA) on the surface of the base is softened by the infrared heating to form a film. After completion of the above process, the base and the face transfer member are cooled to pull the base out of the face transfer member.

The surface roughness of the calcined film of the fluororesin thus obtained was 5.2 μm in terms of a ten point mean roughness (Rz), the surface pattern of the face transfer member was transferred to the surface of the fluororesin layer, and the fluororesin was formed into a film. The surface of the fluororesin layer formed into a film was observed through an electron microscope. As a result, no defects such as cracks were observed on the surface. The processing was able to be conducted in a far shorter period of time than heating (about 20 minutes) by an oven.

EXAMPLE 3

Figure 3A:
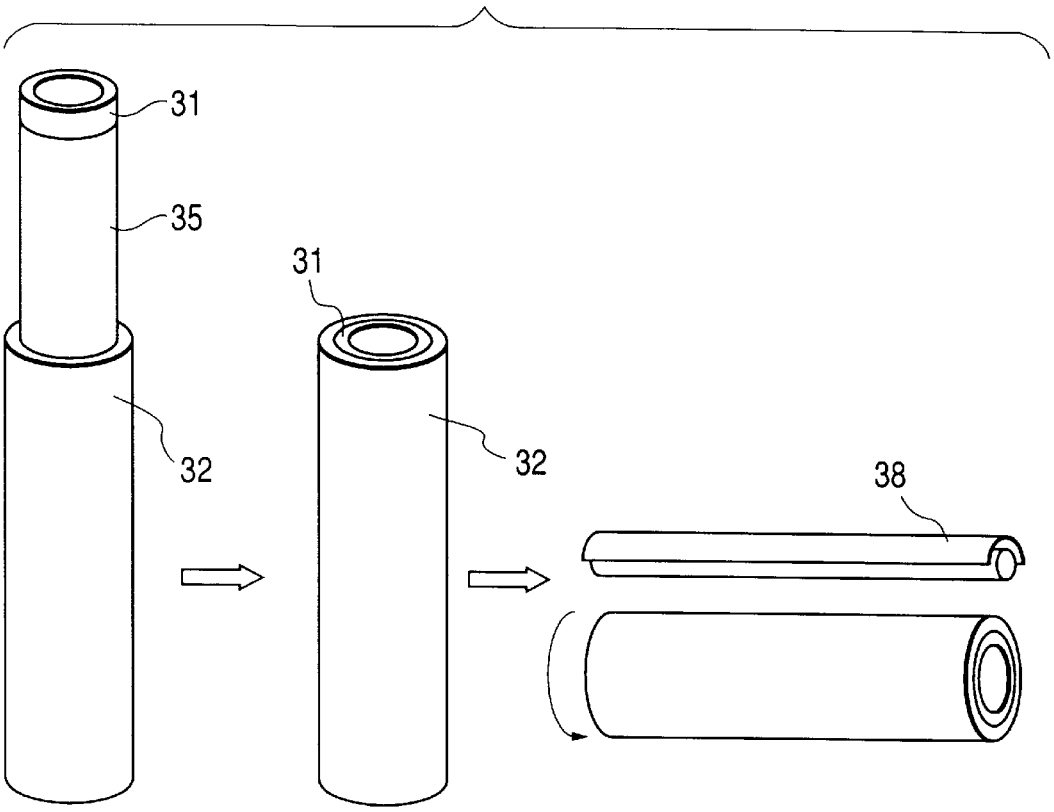
FIGS. 3A and 3B are explanatory drawings of Example 3, wherein FIG. 3A schematically illustrates a fluororesin-coating process.
Figure 3B:
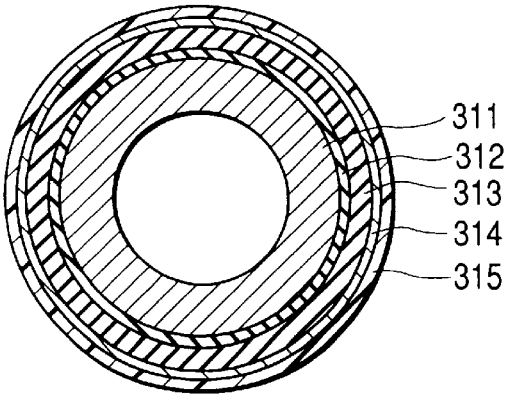

The third example of the present invention is described with reference to FIGS. 3A and 3B.

Reference numeral 31 designates a cylindrical base having a fluororesin coating 35 as its outermost layer. Its cross section is illustrated in FIG. 3B. Reference numeral 311 indicates a mandrel of the cylindrical base, which is formed of SUS and has an external diameter of 40 mm. A silicone rubber layer 313 having a thickness of 1 mm is bonded through a silicone rubber primer layer 312 onto the mandrel 311. The silicone rubber layer 313 is formed by inserting the mandrel coated with the primer in a cylindrical mold, charging unvulcanized, low temperature vulcanizable (LTV) silicone rubber into the mold and curing it under heat. Reference numeral 314 designates a primer layer for bonding the silicone rubber layer 313 to a fluororesin layer to be formed at the surface and is composed of a mixture of fluororubber and a fluororesin (FEP). The primer layer 314 was formed by applying a water-based coating comprising the mixture of fluororubber and the fluororesin by spraying, and heating and curing the coating at 200° C. for 30 minutes, and had a thickness of 25 μm. A layer 315 of a fluororesin (FEP) is formed on the primer layer 314. The fluororesin layer 315 was formed by applying a dispersion of the fluororesin (FEP) by spraying, and drying the dispersion coated at 150° C. for 20 minutes followed by preliminarily heating and calcining at 300° C. for 20 minutes. The thickness thereof was 15 μm. At this time, the fluororesin was not fully formed into a film, and defects such as cracks and irregularities were observed on its surface. The surface roughness of the fluororesin was 15 μm in terms of a ten point mean roughness (Rz). Reference numeral 32 indicates a face transfer member, which is in the form of a cylinder having an internal diameter of 42.2 mm and a wall thickness of 0.05 mm. A surface pattern intended to transfer to the fluororesin film coated on the base is formed on the inner surface of the face transfer member 32. In this example, the inner surface of the face transfer member 32 was worked to a surface roughness of 5 μm before use. A Ni-electroformed film was used as a material for the face transfer member 32. The base 31 with the fluororesin coating 35 preliminary heated and calcined was inserted in the interior of the face transfer member 32, and they were fixed and united together by a fixing member (not shown) in such a manner that the center lines thereof coincide. At this time, there was a clearance of about 60 μm between the base 31 coated with the fluororesin and the face transfer member 32. The base 31 coated with the fluororesin preliminarily heated and calcined and the face transfer member 32, which were united as described above, were heated by an infrared heater 38 from the outside of the face transfer member 32. In this example, an infrared line heater (parallel light type) having an output of 3 kW and a length (300 mm) almost equal to the base was arranged about 50 mm apart from the surface of the face transfer member. In this state, heating was conducted for about 6 minutes at 3 kW. At this time, the thermal expansion of the silicone rubber making up the base is greater than Ni constituting the face transfer member, and the silicone rubber layer expands to a greater extent than the face transfer member composed of Ni, thereby creating a state that the clearance of about 60 μm defined between the face transfer member and the base is filled, and the fluororesin layer is further pressed. In addition, the fluororesin (FEP) on the surface of the base is softened by means of the infrared heating to form a film. After completion of the above process, the base and the face transfer member are cooled to pull the base out of the face transfer member.

The surface roughness of the calcined film of the fluororesin thus obtained was 4.8 μm in terms of a ten point mean roughness (Rz), the surface pattern of the face transfer member was transferred to the surface of the fluororesin layer, and the fluororesin was formed into a film. The surface of the fluororesin layer formed into the film was observed through an electron microscope. As a result, no defects such as cracks were observed on the surface. The processing was able to be conducted in a far shorter period of time than heating (about 20 minutes) by an oven. However, the silicone rubber was recognized to be somewhat deteriorated.

EXAMPLE 4

Figure 4A:
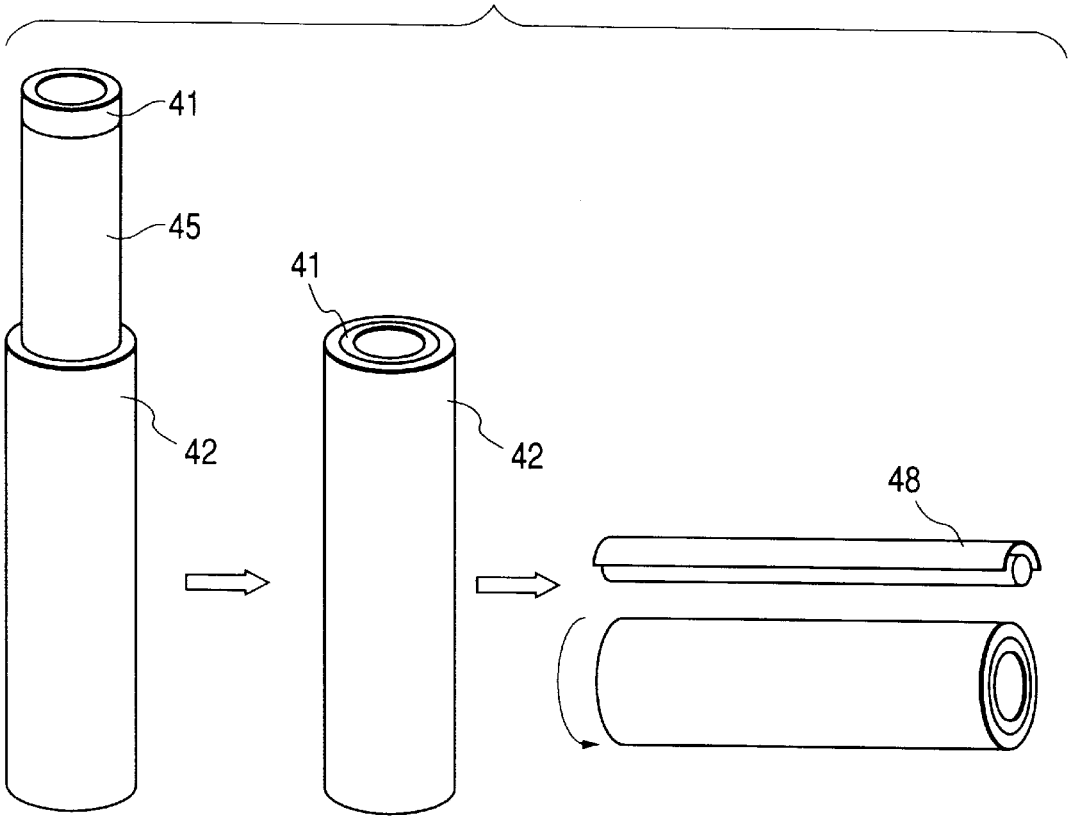
FIGS. 4A and 4B are explanatory drawings of Example 4, wherein FIG. 4A schematically illustrates a fluororesin-coating process.
Figure 4B:
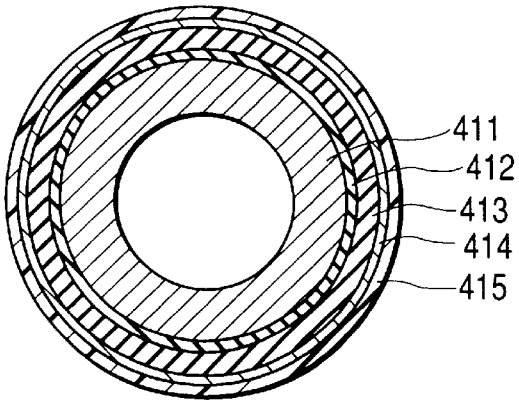

The fourth example of the present invention is described with reference to FIGS. 4A and 4B.

Reference numeral 41 designates a cylindrical base having a fluororesin coating 45 as its outermost layer. Its cross section is illustrated in FIG. 4B. Reference numeral 411 indicates a mandrel of the cylindrical base, which is formed of SUS and has an external diameter of 40 mm. A silicone rubber layer 413 having a thickness of 1 mm is bonded through a silicone rubber primer layer 412 on the mandrel 411. The silicone rubber layer 413 is formed by inserting the mandrel coated with a primer in a cylindrical mold, charging unvulcanized, low temperature vulcanizable (LTV) silicone rubber into the mold and curing it under heat. Reference numeral 414 designates a primer layer for bonding the silicone rubber layer 413 to a fluororesin layer to be formed at the surface and is composed of a mixture of fluororubber and a fluororesin (FEP). The primer layer 414 was formed by applying a water-based coating comprising the mixture of fluororubber and the fluororesin by spraying, and heating and curing the coating at 200° C. for 30 minutes, and had a thickness of 25 μm. A layer 415 of a fluororesin (FEP) is formed on the primer layer 414. The fluororesin layer 415 was formed by applying a dispersion of the fluororesin (FEP) by spraying, and drying the dispersion coated at 150° C. for 20 minutes followed by preliminarily heating and calcining at 300° C. for 20 minutes. The thickness thereof was 15 μm. At this time, the fluororesin was not completely formed into a film, and defects such as cracks and irregularities were observed on its surface. The surface roughness of the fluororesin was 15 μm in terms of a ten point mean roughness (Rz). Reference numeral 42 indicates a face transfer member, which is in the form of a cylinder having an internal diameter of 42.2 mm and a wall thickness of 1 mm. In this example, heat resisting glass was used as a material for the face transfer member 42. A surface pattern intended to transfer to the fluororesin film coated on the base is formed on the inner surface of the face transfer member 42. In this example, the inner surface of the face transfer member 42 had a surface roughness of 5 μm.

The heat resisting glass has a transmittance of 90% or more to infrared radiation, and FEP, or the fluororesin also has a transmittance of about 90% to infrared radiation. In this invention, the mixture of the fluororubber and the fluororesin (FEP) was used as a primer at the fusion-bonding interface. This mixture had a transmittance of 10% or less to infrared radiation.

The base 41 with the fluororesin coating 45 preliminary heated and calcined was inserted in the interior of the face transfer member 42, and they were fixed and united together by a fixing member (not shown) in such a manner that the center lines thereof coincide. At this time, there was a clearance of about 60 μm between the base 41 coated with the fluororesin and the face transfer member 42. The base 41 coated with the fluororesin preliminarily heated and calcined and the face transfer member 42, which were united as described above, were heated by an infrared heater 48 from the outside of the face transfer member 42. In this example, an infrared line heater (parallel light type) having an output of 3 kW and a length (300 mm) almost equal to the base was arranged about 50 mm apart from the surface of the face transfer member. In this state, heating was conducted for about 3 minutes at 3 kW. Since the thermal expansion of the silicone rubber making up the base is greater than the heat resisting glass constituting the face transfer member, and the face transfer member (heat resisting glass) and the fluororesin do not very absorb infrared radiation, and their thermal expansion becomes smaller, and the fusion-bonding interface is selectively heated, the silicone rubber layer expands to a greater extent than the face transfer member composed of the heat resisting glass, whereby a state that the clearance of about 60 μm defined between the face transfer member and the base is filled, and the fluororesin layer is further pressed is efficiently created at low energy. In addition, the fluororesin (FEP) on the surface layer of the base is softened by the infrared heating to form a film. After completion of the above process, the base and the face transfer member are cooled to pull the base out of the face transfer member.

The surface roughness of the calcined film of the fluororesin thus obtained was 4.8 μm in terms of a ten point mean roughness (Rz), the surface pattern of the face transfer member was transferred to the surface of the fluororesin layer, and the fluororesin was formed into a film. The surface of the fluororesin layer formed into the film was observed through an electron microscope. As a result, no defects such as cracks were observed on the surface. Consequently, the processing was able to be conducted in a shorter period of time than the processing in Example 3. In addition, the deterioration of rubber, which may be caused upon the fusion bonding of the fluororesin to the silicone rubber, was also able to be prevented.

Since it is difficult to work heat resisting glass into a cylindrical form with high precision of the inner diameter, and the glass becomes brittle when heated and cooled repeatedly, this case is applied only to a special use.

EXAMPLE 5

Figure 5A:
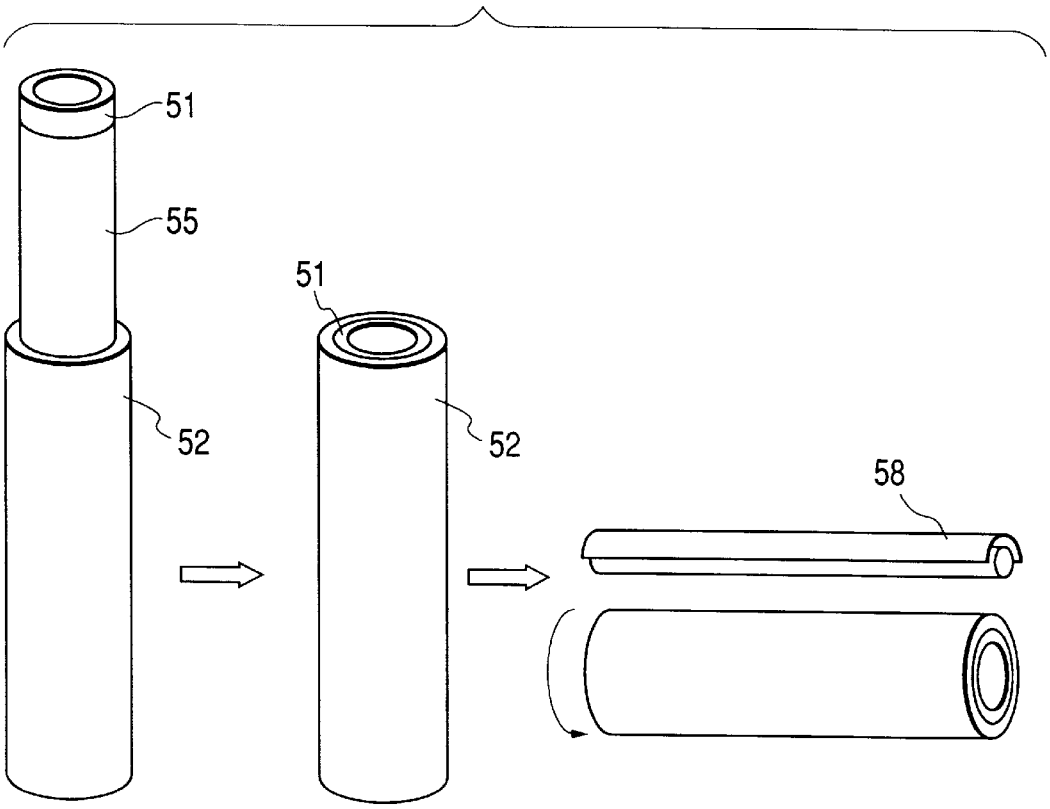
FIGS. 5A and 5B are explanatory drawings of Example 5, wherein FIG. 5A schematically illustrates a fluororesin-coating process.
Figure 5B:
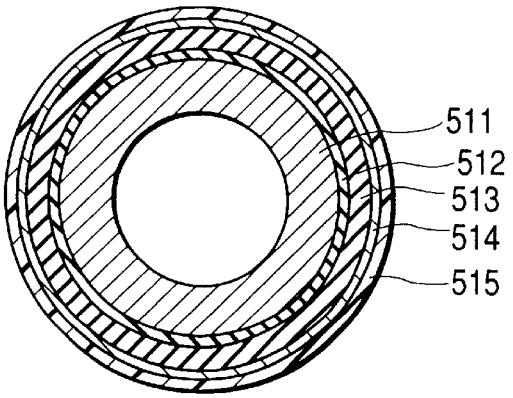

The fifth example of the present invention is described with reference to FIGS. 5A and 5B.

Reference numeral 51 designates a cylindrical base having a fluororesin coating 55 as its outermost layer. Its cross section is illustrated in FIG. 5B. Reference numeral 511 indicates a mandrel of the cylindrical base, which is formed of SUS and has an external diameter of 40 mm. A silicone rubber layer 513 having a thickness of 1 mm is bonded through a silicone rubber primer layer 512 on the mandrel 511. The silicone rubber layer 513 is formed by inserting the mandrel coated with the primer in a cylindrical mold, charging unvulcanized, low temperature vulcanizable (LTV) silicone rubber into the mold and curing it under heat. Reference numeral 514 designates a primer layer for bonding the silicone rubber layer 513 to a fluororesin layer to be formed at the surface and is composed of a mixture of fluororubber and a fluororesin (FEP). The primer layer 514 was formed by applying a water-based coating comprising the mixture of fluororubber and the fluororesin by spraying, and heating and curing the coating at 200° C. for 30 minutes, and had a thickness of 25 $\mu$m. A layer 515 of a fluororesin (FEP) is formed on the primer layer 514. The fluororesin layer 515 was formed by applying a dispersion of the fluororesin (FEP) by spraying, and drying the dispersion coated at 150° C. for 20 minutes followed by preliminarily heating and calcining at 300° C. for 20 minutes. The thickness thereof was 15 $\mu$m. At this time, the fluororesin layer was not completely formed into a film, and defects such as cracks and irregularities were observed on its surface. The surface roughness of the fluororesin layer was 15 $\mu$m in terms of a ten point mean roughness (Rz). Reference numeral 52 indicates a face transfer member, which is in the form of a cylinder having an internal diameter of 42.2 mm and a wall thickness of 0.05 mm. In this example, polyimide was used as a material for the face transfer member 52. A surface pattern intended to transfer to the fluororesin film coated on the base is formed on the inner surface of the face transfer member 52. In this example, the inner surface of the face transfer member 52 had a surface roughness of 5 $\mu$m.

The polyimide has a transmittance of 90% to infrared radiation, and the fluororesin (FEP) also has a transmittance of about 90% to infrared radiation. In this invention, the mixture of the fluororubber and the fluororesin (FEP) was used as a primer at the fusion-bonding interface. This mixture had a transmittance of 10% or less to infrared radiation.

The base 51 with the fluororesin coating 55 preliminary heated and calcined was inserted in the interior of the face transfer member 52, and they were fixed and united together by a fixing member (not shown) in such a manner that the center lines thereof coincide. At this time, there was a clearance of about 60 $\mu$m between the base 51 coated with the fluororesin and the face transfer member 52. The base 51 with the fluororesin coating preliminarily heated and calcined and the face transfer member 52, which were united as described above, were heated by an infrared heater 58 from the outside of the face transfer member 52. In this example, an infrared line heater (parallel light type) having an output of 3 kW and a length (300 mm) almost equal to the base was arranged about 50 mm apart from the surface of the face transfer member. In this state, heating was conducted for about 3 minutes at 3 kW. Since the thermal expansion of the silicone rubber making up the base is greater than the polyimide constituting the face transfer member, and the face transfer member (polyimide) and the fluororesin do not absorb infrared radiation well, and their thermal expansion becomes smaller, and the fusion-bonding interface is selectively heated, the silicone rubber layer expands to a greater extent than the face transfer member composed of the polyimide, whereby a state that the clearance of about 60 $\mu$m defined between the face transfer member and the base is filled, and the fluororesin layer is further pressed and is efficiently created at low energy. In addition, the fluororesin (FEP) on the surface layer of the base is softened by the infrared heating to form a film. After completion of the above process, the base and the face transfer member are cooled to pull the base out of the face transfer member.

The surface roughness of the calcined film of the fluororesin thus obtained was 4.8 $\mu$m in terms of a ten point mean roughness (Rz), the surface pattern of the face transfer member was transferred to the surface of the fluororesin, and the fluororesin was formed into a film. The surface of the fluororesin layer formed into the film was observed through an electron microscope. As a result, no defects such as cracks were observed on the surface. It goes without saying that the deterioration of rubber, which may be caused upon the fusion bonding of the fluororesin to the silicone rubber, was also prevented.

The polyimide film can be easily produced by preparing a master having a desired surface accuracy with high precision, applying polyimide onto the master, curing the polyimide and separating the cured polyimide from the master. Since the polyimide film is excellent in high-temperature strength, the durability of the face transfer member upon repeated use can be enhanced. In addition, the polyimide film has good flexibility, and is hence easy to handle and suitable for mass production.

EXAMPLE 6

Figure 6A:
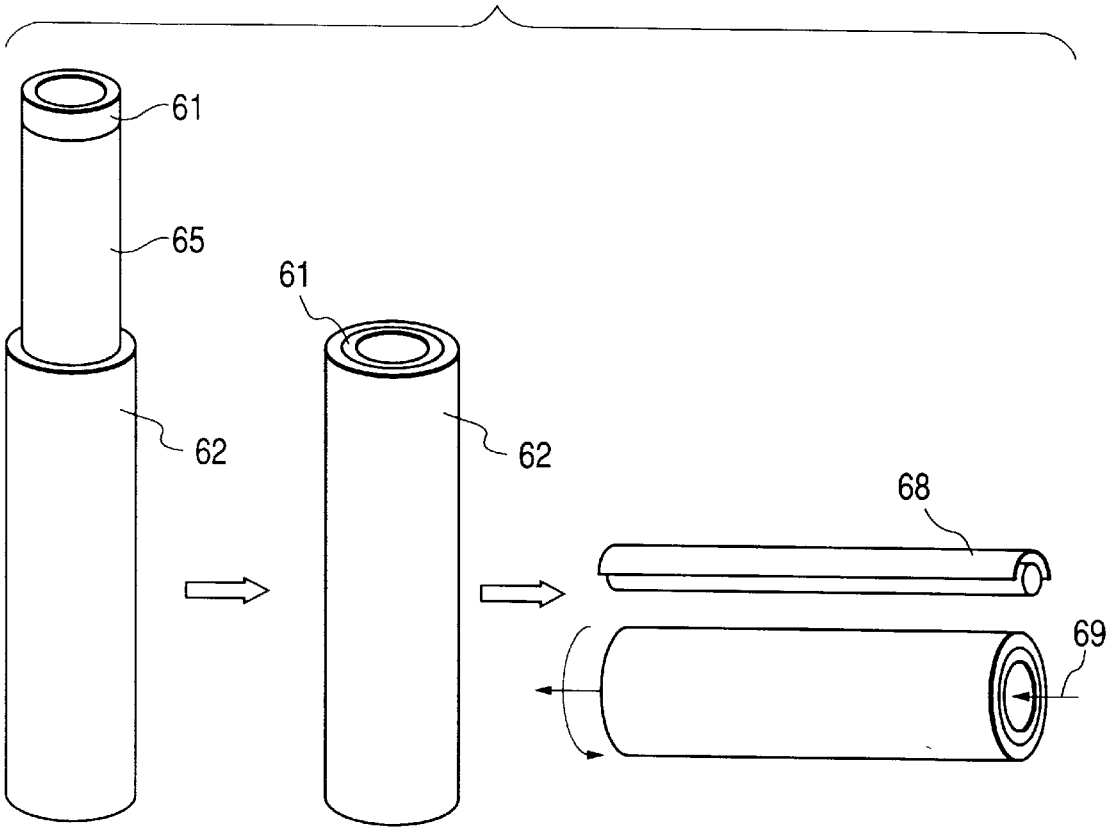
FIGS. 6A and 6B are explanatory drawings of Example 6, wherein FIG. 6A schematically illustrates a fluororesin-coating process.
Figure 6B:
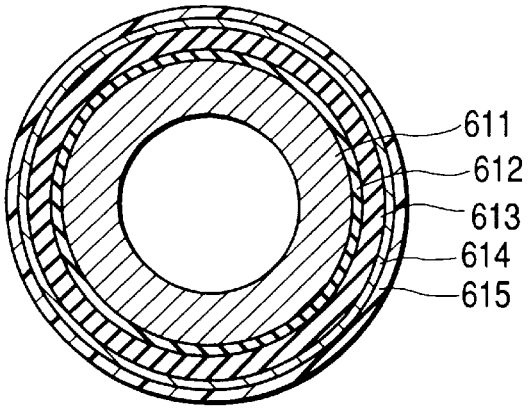

The sixth example of the present invention is described with reference to FIGS. 6A and 6B. FIG. 6A illustrates substantially the same fluororesin-coating process as that in FIG. 5A except for using cooling air, and FIG. 6B illustrates a cross section of a base coated with a fluororesin which has substantially the same structure as the base in FIG. 5B. In these drawings, reference numeral 61 denotes a cylindrical base having a fluororesin 65 preliminarily heated and calcined, 62 a face transfer member formed of polyimide, 68 an infrared heater, 69 cooling air, 611 a mandrel, 612 a silicone rubber primer layer, 613 a silicone rubber layer, 614 a primer layer formed of a mixture of fluororubber and fluororesin, and 615 a fluororesin layer.

Upon processing under the same conditions as in Example 5, cooling air 69 of −10° C. was allowed to flow at a flow rate of one liter per minute through the vacant space of the hollow cylindrical mandrel for each 5 minutes before and after irradiation of infrared radiation. By this process, the time required for the step of cooling the base and face transfer member and then pulling the base out of the face transfer member could be shortened though it had heretofore taken about 10 minutes after the heating. Even when the infrared heating was conducted at an output of 3.5 kW for 2.5 minutes, substantially the same calcined film of the fluororesin as those described above was obtained. The surface roughness thereof was 4.8 μm in terms of a ten point mean roughness (Rz), the surface pattern of the face transfer member was transferred to the surface of the fluororesin, and the fluororesin was formed into a film. The surface of the fluororesin layer formed into the film was observed through an electron microscope. As a result, no defects such as cracks were observed on the surface. It goes without saying that the deterioration of rubber, which may be caused upon the fusion bonding of the fluororesin to the silicone rubber, was also prevented. Consequently, the time required up to the pulling out of the base from the face transfer member was able to be shortened compared with Example 5, though it is a little.

EXAMPLE 7

Figure 7A:
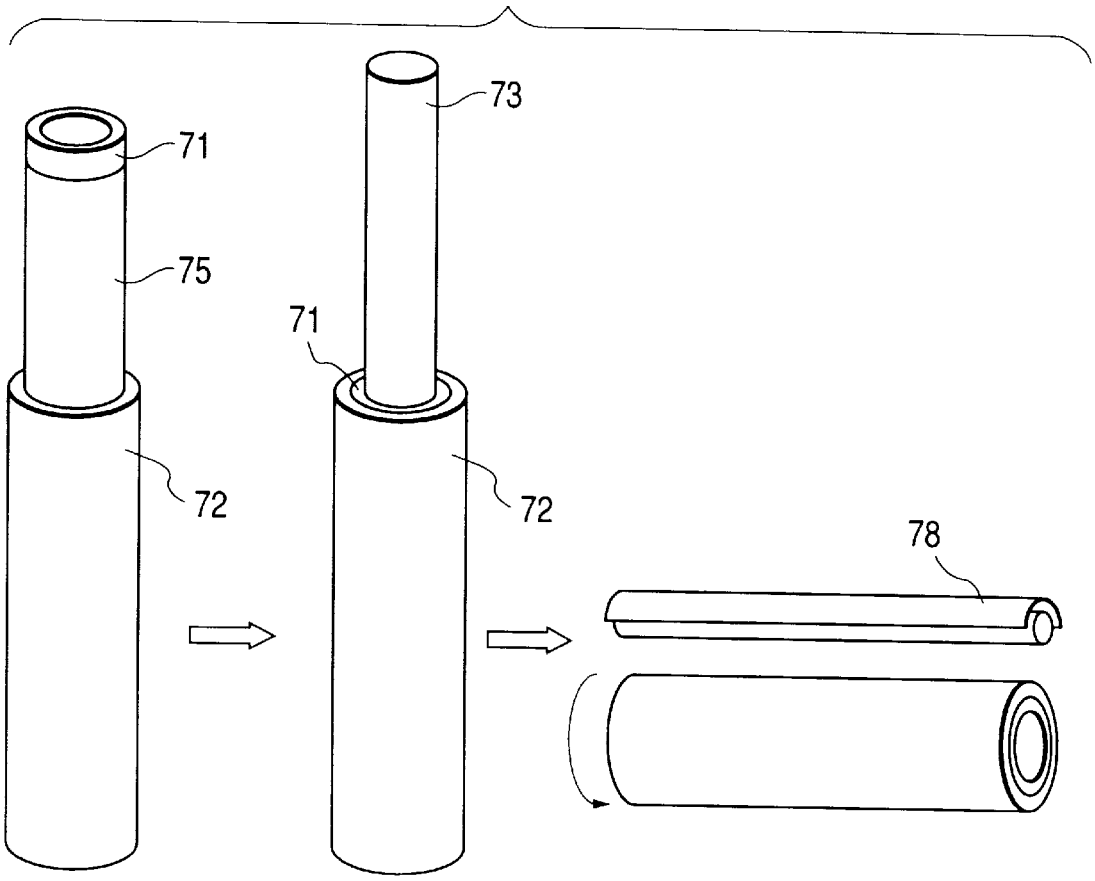
FIGS. 7A and 7B are explanatory drawings of Example 7, wherein FIG. 7A schematically illustrates a fluororesin-coating process.
Figure 7B:
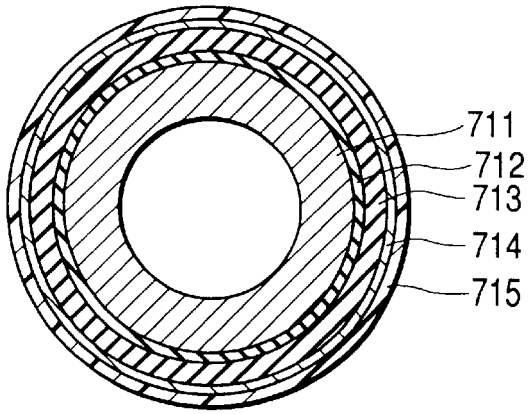

The seventh example of the present invention is described with reference to FIGS. 7A and 7B.

Reference numeral 71 designates a cylindrical base having a fluororesin coating 75 as its outermost layer. Its cross section is illustrated in FIG. 7B. Reference numeral 711 indicates a thermosetting polyimide film having a thickness of 50 μm and an external diameter of 40 mm forming a base layer of the cylindrical base. A silicone rubber layer 713 having a thickness of 300 μm is bonded through a silicone rubber primer layer 712 onto the polyimide film 711. The silicone rubber layer 713 is formed by applying a solution of unvulcanized, low temperature vulcanizable (LTV) silicone rubber in toluene onto the polyimide film coated with the primer by spraying and curing the silicone rubber under heat. Reference numeral 714 designates a primer layer for bonding the silicone rubber layer 713 to a fluororesin surface layer and is composed of a mixture of fluororubber and a fluororesin (FEP). A layer 715 of a fluororesin (FEP) is formed on the primer layer 714. The fluororesin layer 715 was formed by applying a dispersion of the fluororesin (FEP) by spraying, and drying the dispersion coated at 150° C. for 20 minutes followed by preliminarily heating and calcining at 300° C. for 20 minutes. The thickness thereof was 15 μm. At this time, the fluororesin layer was not completely formed into a film, and defects such as cracks and irregularities were observed on its surface. The surface roughness of the fluororesin was 15 μm in terms of a ten point mean roughness (Rz).

Reference numeral 72 indicates a face transfer member, which is in the form of a cylinder having an internal diameter of 42.8 mm and a wall thickness of 0.05 mm. A surface pattern intended to transfer to the fluororesin film coated on the base is formed on the inner surface of the face transfer member 72. In this example, the inner surface of the face transfer member 72 was worked to a surface roughness of 5 μm before use, and polyimide was used as a material for the face transfer member 72.

An internally-fixing cylindrical jig 73 (made of aluminum) having an external diameter substantially equal to the internal diameter of the polyimide film was inserted into the base 71 with the fluororesin coating 75 preliminary heated and calcined to unite them. The united body was inserted in the interior of the face transfer member 72, and they were fixed and united together by a fixing member (not shown) in such a manner that the center lines thereof coincide. At this time, there was a clearance of about 60 μm between the base 71 coated with the fluororesin tube and the face transfer member 72.

The base 71 with the fluororesin coating preliminarily heated and calcined and the face transfer member 72, which were united as described above, were heated by an infrared heater 78 from the outside of the face transfer member 72. In this example, an infrared line heater (parallel light type) having an output of 3 kW and a length (300 mm) almost equal to the base was arranged about 50 mm apart from the surface of the face transfer member. In this state, heating was conducted for about 3 minutes at 3 kW. Since the thermal expansion of the silicone rubber making up the base is greater than the polyimide constituting the face transfer member, and the face transfer member (polyimide) and the fluororesin do not absorb infrared radiation, so their thermal expansion becomes smaller, and the fusion-bonding interface is selectively heated, the silicone rubber layer expands to a greater extent than the face transfer member composed of the polyimide, whereby a state that the clearance of about 60 μm defined between the face transfer member and the base is filled, and the fluororesin layer is further pressed is efficiently created at low energy. In addition, the fluororesin (FEP) on the surface layer of the base is softened by the infrared heating to form a film. After completion of the above process, the base and the face transfer member are cooled to pull the base out of the face transfer member.

The surface roughness of the calcined film of the fluororesin thus obtained was 4.9 μm in terms of a ten point mean roughness (Rz), the surface pattern of the face transfer member was transferred to the surface of the fluororesin, and the fluororesin was formed into a film. The surface of the fluororesin layer formed into the film was observed through an electron microscope. As a result, no defects such as cracks were observed on the surface. It goes without saying that the deterioration of rubber, which may be caused upon the fusion bonding of the fluororesin to the silicone rubber, was also able to be prevented. Namely, such a filmy base layer as described above was also able to be coated with the fluororesin.

EXAMPLE 8

A fixing roller for a color image forming apparatus was produced in the same manner as in Example 5.

Figure 8:
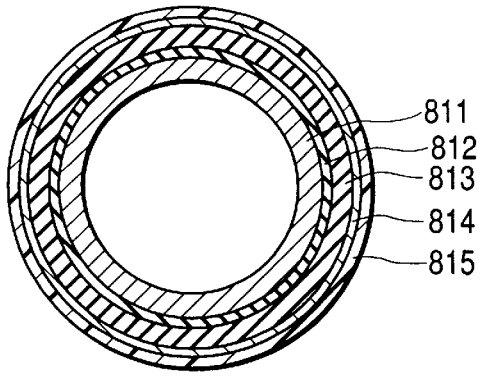
FIG. 8 is a cross-sectional view of a fixing roller according to Example 8.

FIG. 8 is a cross-sectional view illustrating the fixing roller used in the color image forming apparatus. Reference numeral 811 indicates an aluminum mandrel of the fixing roller, which has an external diameter of 58 mm. A silicone rubber layer 813 having a thickness of 1 mm, a primer layer 814 composed of a mixture of fluororubber and a fluororesin and having a thickness of 25 μm, and a layer 815 of a fluororesin (FEP) are formed on the mandrel in the same manner as in Example 5. Reference numeral 812 denotes a silicone rubber primer layer. The fluororesin layer 815 was formed by applying a dispersion of the fluororesin (FEP) by spraying, and drying the dispersion coated at 150° C. for 20 minutes followed by preliminarily heating and calcining at 300° C. for 20 minutes. The thickness thereof was 15 μm. At this time, the fluororesin layer was not fully formed into a film, and so defects such as cracks and irregularities were observed on its surface. The surface roughness of the fluororesin was 15 μm in terms of a ten point mean roughness (Rz).

The fixing roller base thus prepared was inserted in the interior of a face transfer member 82 formed with polyimide in the form of a cylinder having an internal diameter of 60.2 mm and a wall thickness of 0.05 mm, and they were fixed and united together. The fixing roller base and face transfer member thus-united were heated for about 3 minutes from the outside of the face transfer member by means of an infrared line heater (parallel light type) having an output of 3 kW and a length (300 mm) almost equal to the base, which was arranged about 50 mm apart from the surface of the face transfer member. At this time, three kinds of face transfer members the inner surfaces of which had surface roughnesses of 10 μm (Example 8.1), 5 μm (Example 8.2) and 2 μm (Example 8.3), respectively, in terms of a ten point mean roughness (Rz) were provided to produce fixing rollers under the conditions described above. With respect to the fixing rollers produced by using the respective face transfer members, the surface roughnesses and the evaluation as fixing rollers are shown in Table 1.

COMPARATIVE EXAMPLE 1

With respect to the same fixing roller base coated with the fluororesin preliminarily heated and calcined as that produced in Example 8, the surface roughness was measured without conducting the face transfer step, and an image formed by using this roller base as a fixing roller was evaluated. The results are shown in Table 1. However, defects such as cracks and irregularities remained on the surface of the fixing roll.

TABLE 1

| | Surface roughness of inner surface of face transfer member, Rz (μm) | Surface roughness of fixing roller, Rz (μm) | Evaluation of image as to gloss irregularity |
|---|---|---|---|
| Comp. Ex. 1 | Conducting no face transfer step | 15.2 | C |
| Ex. 8.1 | 10.0 | 10.3 | B |
| Ex. 8.2 | 5.0 | 4.8 | A |
| Ex. 8.3 | 2.0 | 2.2 | A |

A: No gloss irregularity occurred;
B: Gloss irregularity partially occurred;
C: Gloss irregularity occurred.

It is apparent from Table 1 that the surface of the fluororesin layer can be formed in the desired roughness by controlling the surface roughness of the inner surface of the face transfer member. In addition, the gloss irregularity of image, which becomes a problem in color image forming apparatus, is solved by controlling the surface roughness of the fluororesin layer in the above-described manner.

EXAMPLE 9

A pressure roller for an image forming apparatus using a film fixing system by pressure roller drive was produced in the same manner as in Example 5.

Figure 9:
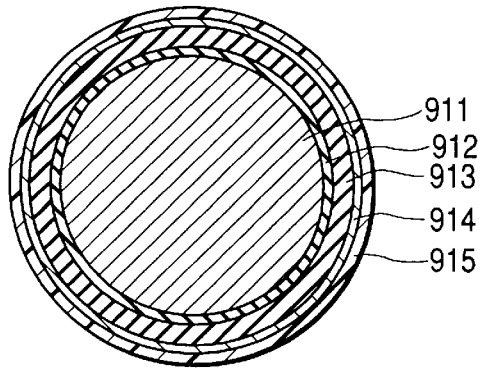
FIG. 9 is a cross-sectional view of a pressure roller according to Example 9.

FIG. 9 is a cross-sectional view illustrating the pressure roller used in a fixing device of the film fixing system by a pressure roller drive. Reference numeral 911 indicates an aluminum mandrel of the pressure roller, which has an external diameter of 10 mm. A silicone rubber layer 913 having a thickness of 3 mm, a primer layer 914 composed of a mixture of fluororubber and a fluororesin and having a thickness of 25 μm, and a layer 915 of a fluororesin (FEP) are formed on the mandrel in the same manner as in Example 5. Reference numeral 912 denotes a silicone rubber primer layer. The fluororesin layer 915 was formed by applying a dispersion of the fluororesin (FEP) by spraying, and drying the dispersion coated at 150° C. for 20 minutes followed by preliminarily heating and calcining the dry film at 300° C. for 20 minutes. The thickness thereof was 15 μm. At this time, the fluororesin was not completely formed into a film, and defects such as cracks and irregularities were observed on its surface. The surface roughness of the fluororesin layer was 15 μm in terms of a ten point mean roughness (Rz).

The fixing roller base thus prepared was inserted in the interior of a face transfer member 92 formed with polyimide in the form of a cylinder having an internal diameter of 16.6 mm and a wall thickness of 0.05 mm, and they were fixed and united together. The fixing roller base and face transfer member thus-united were heated for about 3 minutes from the outside of the face transfer member by means of an infrared line heater (parallel light type) having an output of 3 kW and a length (300 mm) almost equal to the base, which was arranged about 50 mm apart from the surface of the face transfer member. At this time, three kinds of face transfer members the inner surfaces of which had surface roughnesses of 25 μm (Example 9.1), 10 μm (Example 9.2) and 1.5 μm (Example 9.3), respectively, in terms of a ten point mean roughness (Rz) were provided to produce pressure rollers under the conditions described above. With respect to the pressure rollers produced by using the respective face transfer members, the surface roughnesses and the evaluation as pressure rollers are shown in Table 2.

COMPARATIVE EXAMPLE 2

The same pressure roller base coated with the fluororesin preliminarily heated and calcined as that produced in Example 9 was subjected to infrared heating for about 10 minutes under the same conditions as in Example 9 except that the base was not inserted in the interior of the face transfer member, thereby forming the fluororesin into a film. This heating period of time is the time necessary for completely forming the surface layer into a film. Therefore, the surface roughness thereof was improved, but the underlying silicone rubber was deteriorated, and its compression set was deteriorated, and the feeding property of the resulting pressure roller was also deteriorated.

With respect to this pressure roller, the measurement of surface roughness and evaluation as to feeding property and an image formed using the pressure roller were conducted. The results are shown in Table 2.

TABLE 2

| | Surface roughness of inner surface of face transfer member, Rz (μm) | Surface roughness of pressure roller, Rz (μm) | Feeding property | Evaluation of image as to density irregularity |
|---|---|---|---|---|
| Comp. Ex. 2 | Conducting no face transfer step | 3.9 | B | A |
| Ex. 9.1 | 25.0 | 23.3 | A | C |
| Ex. 9.2 | 10.0 | 9.3 | A | A |
| Ex. 9.3 | 1.5 | 1.8 | C | A |

A: No density irregurality occurred;
B: Density irregularity partially occurred;
C: Density irregularity occurred.

It is apparent from Table 2 that the surface of the fluororesin layer can be formed in the desired roughness by controlling the surface roughness of the inner surface of the face transfer member. In addition, the lowering of transfer medium feeding property and formation of defective images, which become a problem in the film fixing device by a pressure roller drive, are solved by controlling the surface roughness of the fluororesin layer in the above-described manner.

What is claimed is:

1. A fluororesin-coating process which comprises the steps of inserting a base having powder of the fluororesin on its surface in the interior of a cylindrical face transfer member; and heating both the base and the face transfer member by means of an infrared heater from the outside of the face transfer member, thereby heating them in a state that the fluororesin powder layer is pressed by making use of a difference in coefficient of thermal expansion between the base and the face transfer member to form a fluororesin layer on an outer surface of the base.

2. The fluororesin-coating process according to claim 1, wherein the fluororesin powder is applied to the surface of the base by applying a water-based coating comprising the fluororesin.

3. The fluororesin-coating process according to claim 1, wherein the fluororesin powder on the surface of the base is fixed to the surface of the base by heating and calcining the powder.

4. The fluororesin-coating process according to claim 1, wherein the base is composed of multi-layers, and an inner surface layer of the base is formed of rubber.

5. The fluororesin-coating process according to claim 1, wherein the face transfer member transmits at least 50% of infrared radiation.

6. The fluororesin-coating process according to claim 1, wherein the degree of infrared absorption of the individual components is in the following relation:

$$\text{face transfer member} \leqq \text{fluororesin layer} < \text{base surface}.$$

7. The fluororesin-coating process according to claim 1, wherein the face transfer member is a tube formed with a material selected from the group consisting of polyimide, Ni-electroformed film and glass.

8. The fluororesin-coating process according to claim 1, wherein an inner surface of the base is cooled before the heating and/or during the heating.

* * * * *

UNITED STATES PATENT AND TRADEMARK OFFICE

CERTIFICATE OF CORRECTION

PATENT NO. : 6,132,815
DATED : October 17, 2000
INVENTOR(S) : Masaaki Takahashi et al It is certified that error appears in the above-identified patent and that said Letters Patent is hereby corrected as shown below:

Column 3,
Line 6, "in" should read -- in the -- ;
Line 21, "layer" (2nd occurrence) should read -- layer, -- ;
Line 22, "layer," (1st occurrence) should read -- layer -- .

Column 4,
Line 25, "Examples," should read -- the examples, -- .

Column 5,
Line 50, "by heat" should be deleted.

Column 6,
Line 65, "printed" should read -- a printed -- .

Column 8,
Line 37, "cross section" should read -- cross-section -- .

Column 9,
Line 30, "was" (1st occurrence) should read -- were -- .

Column 11,
Line 13, "preliminary" should read -- preliminarily -- .

Column 12,
Line 50, "very" should be deleted.

Column 15,
Line 65, "preliminary" should read -- preliminarily -- .

Column 16,
Line 24, "pressed" should read -- pressed and -- .

UNITED STATES PATENT AND TRADEMARK OFFICE

CERTIFICATE OF CORRECTION

PATENT NO. : 6,132,815
DATED : October 17, 2000
INVENTOR(S) : Masaaki Takahashi et al It is certified that error appears in the above-identified patent and that said Letters Patent is hereby corrected as shown below:

Column 17,
Line 10, "members" should read -- members, -- ;
Line 13, "(Rz)" should read -- (Rz), -- , Column 18,
Line 13, insert -- the -- before "face";
Line 58, "irregurality" should read -- irregularity -- .

Signed and Sealed this

Fourth Day of September, 2001

*Attest:*

Nicholas P. Godici

*Attesting Officer*

NICHOLAS P. GODICI
*Acting Director of the United States Patent and Trademark Office*